US005324706A

United States Patent [19]

Defieuw et al.

[11] Patent Number: 5,324,706

[45] Date of Patent: Jun. 28, 1994

[54] DYE-DONOR ELEMENT FOR THERMAL DYE SUBLIMATION TRANSFER

[75] Inventors: Geert Defieuw, Kessel-Lo; August Mariën, Westerlo, both of Belgium

[73] Assignee: AGFA-Gevaert, N.V., Mortsel, Belgium

[21] Appl. No.: 21,454

[22] Filed: Feb. 23, 1993

[30] Foreign Application Priority Data

Mar. 30, 1992 [EP] European Pat. Off. ..... 92200907

[51] Int. Cl.[5] ..... B41M 5/035; B41M 5/38

[52] U.S. Cl. ..... 503/227; 428/195; 428/206; 428/327; 428/412; 428/480; 428/500; 428/913; 428/914

[58] Field of Search ..... 8/471; 428/195, 480, 428/913, 914, 206, 327, 484, 412; 503/227

[56] References Cited

U.S. PATENT DOCUMENTS 4,727,057 2/1988 Harrison et al. ..... 503/227

*Primary Examiner*—B. Hamilton Hess

*Attorney, Agent, or Firm*—Breiner & Breiner

[57] ABSTRACT

Dye-donor element for use according to thermal dye sublimation transfer comprising a support having on one side a dye layer and on the other side a heat-resistant layer, said support carrying on at least one side a subbing layer comprising a polyester formed by polycondensation of at least one aromatic dicarboxylic acid and at least one aliphatic diol, wherein said polyester is a copolyester further comprising units derived from at least one multifunctional comonomer carrying at least 3 functional groups, which may be same or different and are chosen from hydroxy and carboxy groups including so-called latent carboxy groups.

13 Claims, 1 Drawing Sheet

DYE-DONOR ELEMENT FOR THERMAL DYE SUBLIMATION TRANSFER

BACKGROUND OF THE INVENTION

1. Field of the Invention

Figure 1:
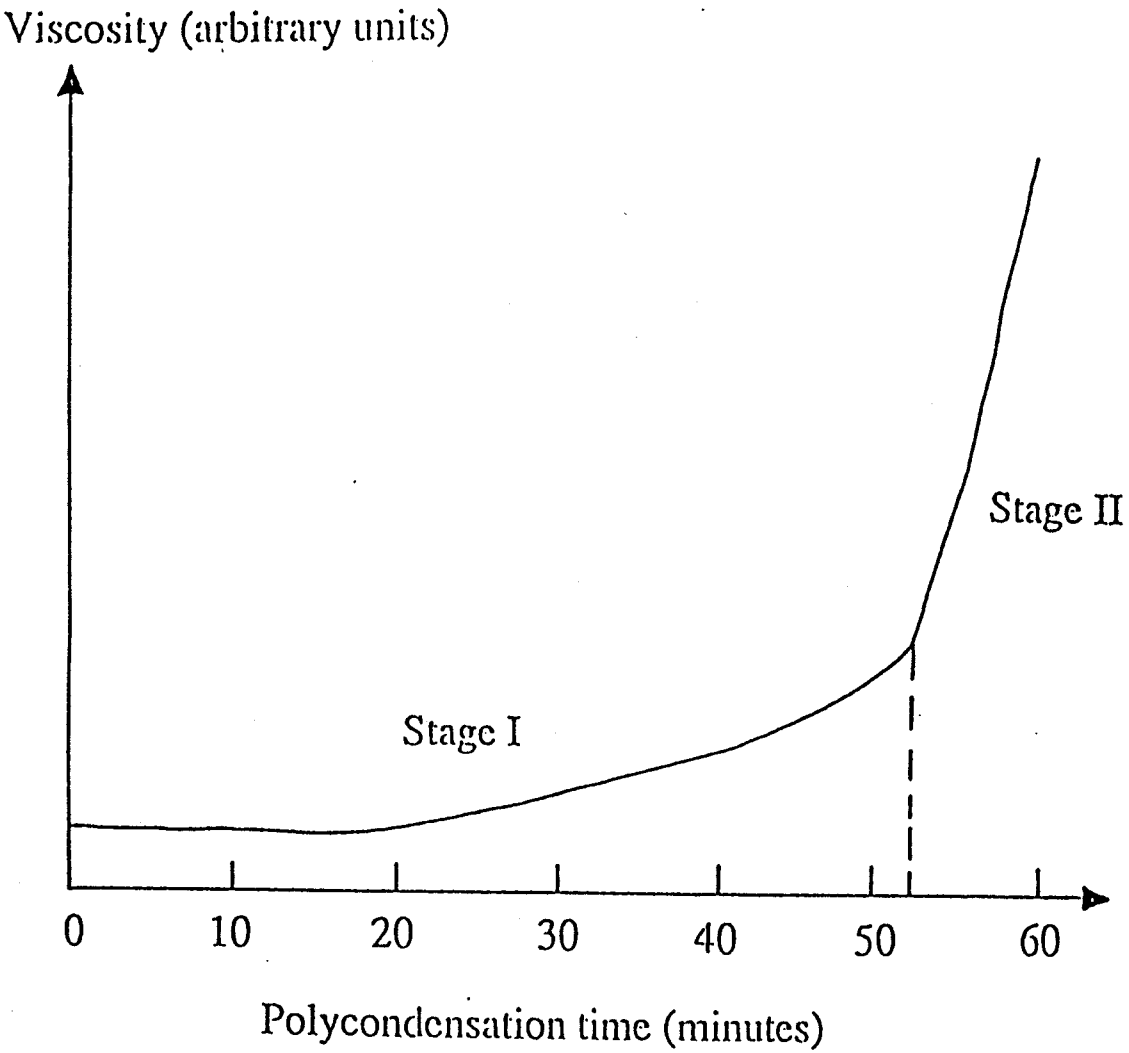

The present invention relates to dye-donor elements for use in thermal dye sublimation transfer methods, the dye-donor elements comprising a subbing layer that improves the adhesion between the polymeric support and the dye layer and/or between the polymeric support and the heat-resistant layer.

2. Background of the Invention

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, heated with a thermal printing head provided with a plurality of juxtaposed heat-generating resistors so as to transfer dye from the selectively heated regions of the dye-donor element to the receiver sheet, thus forming a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which is covered with a dye layer that contains the printing dyes. Usually an adhesive or subbing layer is provided between the support and the dye layer.

During the printing operation the thin support softens when heated and thereby may stick to the thermal printing head, thus causing malfunction of the printing apparatus and reduction in image quality. To avoid this and to facilitate passage of the dye-donor element under the thermal printing head the rear side of the support (side opposite to that of the dye layer) may typically be provided with a heat-resistant layer. An adhesive or subbing layer layer is usually provided between the support and the heat-resistant layer. Such subbing layers have been disclosed in e.g. EP 138,483, EP 227,090, EP 407,220, EP 433496, U.S. Pat. Nos. 4,572,860, 4,717,711, 4,559,273, 4,695,288, 4,727,057, 4,737,486, 4,965,239, 4,753,921, 4,895,830, 4,929,592, 4,748,150, 4,965,238, and 4,965,241.

Thin subbing layers of the polyesters disclosed in EP 407,220 and U.S. Pat. No. 4,727,057 tend to solubilize when they are covered with the heat-resistant layer.

Provided they are used in the form of thick subbing layers, random linear copolyesters such as those described in U.S. Pat. No. 4,727,057 and in EP 407,220, exhibit good adhesion properties in respect of the heat-resistant layer.

The use of thick polyester subbing layers results, however, in a lower degree of stability of the dye-donor element in rolled form and in a lower thermostability of the heat-resistant layer owing to mixing of a part of the polyester with the polymers present in the heat-resistant layer.

3. SUMMARY OF THE INVENTION

It is an object of the present invention to provide dye-donor elements that do not have the above-mentioned disadvantages.

It is a further object of the invention to provide dye-donor elements with an improved adhesion between the polymeric support and the dye layer and/or between the polymeric support and the heat-resistant layer.

According to the present invention a dye-donor element for use according to thermal dye sublimation transfer is provided, said dye-donor element comprising a support having on one side a dye layer and on the other side a heat-resistant layer, said support carrying on at least one side a subbing layer comprising a polyester formed by polycondensation of at least one aromatic dicarboxylic acid and at least one aliphatic diol, wherein said polyester is a copolyester further comprising units derived from at least one multifunctional comonomer carrying at least 3 functional groups, which may be same or different and are chosen from hydroxy and carboxy groups including so-called latent carboxy groups.

By the expression "latent carboxy groups" an anhydride group is meant, which has been formed by ring closure using 2 carboxy groups, the anhydride group in the context of the present invention thus accounting for 2 carboxy groups.

The aromatic dicarboxylic acid(s) used in the polycondensation for forming a polyester can be chosen from dibasic acids such as terephthalic acid and isophthalic acid, whereas the aliphatic diol(s) can be chosen from i.a. ethylene glycol, propylene glycol, butanediol, neopentyl glycol, 1,4-cyclohexanediol, and diethylene glycol.

The at least one multifunctional comonomer in the copolyester for use according to the present invention can be chosen from e.g. a multifunctional alcohol comprising at least 3 hydroxy groups, a multifunctional carboxylic acid comprising at least 3 carboxy groups, and a multifunctional carboxylic acid comprising 1 carboxy group and an anhydride group formed by ring closure using 2 carboxy groups.

4. Detailed Description of the Invention

Examples of multifunctional alcohols are triols such as glycerol and trimethylol propane and compounds containing four hydroxy groups such as pentaerithrytol.

Examples of multifunctional carboxylic acids are trimellitic acid, trimellitic anhydride, and pyromellitic acid.

Multifunctional hydroxyacids, the acid group(s) of which is (are) a (a) carboxylic acid group(s), can also be used. Examples of such hydroxyacids are e.g. citric acid and tartaric acid.

The copolyester may further contain units derived from aliphatic difunctional comonomers having both hydroxy and carboxy groups e.g. glycolic acid and/or units derived from aliphatic dicarboxylic acids e.g. adipic acid.

The copolyester of the present invention can be prepared by conventional techniques known for polyester synthesis. Melt polycondensation is highly preferred. During the polycondensation reaction the melt viscosity increases rather slowly during the initial stages of the polymerisation. At the onset of the crosslinking reaction, however, a dramatic increase in melt viscosity is observed.

When the crosslinking reaction is stopped deliberately after a short crosslinking period, a copolyester can be obtained which remains soluble in organic solvents. At high crosslinking levels, however, a non-soluble copolyester is obtained, which can be coated only from dispersion. Therefore, slightly crosslinked copolyesters that are soluble in organic solvents are preferred.

Preferably, the copolyester of the present invention comprises 0.1 to 10 mol % of units derived from multifunctional comonomer(s). More preferably, the copolyester comprises 0.25 to 5 mol % of units derived from multifunctional comonomer(s).

Copolyesters for use according to the present invention, which are soluble in ketones such as acetone and methyl ethyl ketone, are highly preferred. Although coating from organic solutions is highly preferred in order to achieve excellent film-forming properties, aqueous dispersions of copolyesters of the present invention can also be used for coating. For that purpose water-dispersible copolyesters can be prepared by introducing sulpho-isophthalic acid therein.

The subbing layer can further comprise other polymers, particles, or low molecular weight additives. Compounds such as those described in EP 433,496 are especially preferred.

The subbing layer of the present invention is applied directly to the support of the dye-donor element at the side of the support that will carry the dye layer, or at the rear side of the support, or advantageously at both sides of the support. When applied to the rear side, the subbing layer can be covered with a heat-resistant layer as disclosed in e.g. EP 153,880, EP 194,106, EP 267,469, EP 314,348, EP 329,117, JP 60/151096, JP 60/229,787, JP 60/229,792, JP 60/229,795, JP 62/48589, JP 62/212,192, JP 62,259,889, JP 01/5884, JP 01/56587, JP 02/128,899, JP 58/187,396, JP 63/191,678, JP 63/191,679, JP 01/234,292, JP 02,70485, and EP-A 91202071.6 and the corresponding U.S. Ser. No. 07/921,087.

The use in the heat-resistant layer of at least one polycarbonate derived from a bis-(hydroxyphenyl)-cycloalkane as disclosed in the latter EP-A 91202071.6 and corresponding to the following general formula:

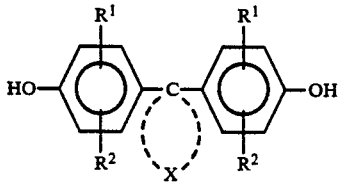

wherein each of $R^1$ and $R^2$ (same or different) represents hydrogen, a halogen atom, a $C_1$–$C_8$ alkyl group, a $C_5$–$C_6$ cycloalkyl group, a $C_6$–$C_{10}$ aryl group, or a $C_7$–$C_{12}$ aralkyl group and X represents the atoms needed to close a 5- to 8-membered cycloaliphatic ring, which may be substituted with one or more $C_1$–$C_6$ alkyl groups or 5- or 6-membered cycloalkyl groups and which may carry fused-on 5- or 6-membered cycloalkyl groups, is especially preferred for its high thermostability and ease of application.

Preferably, said at least one polycarbonate derived from bis-(hydroxyphenyl)-cycloalkane is 1,1-bis-(4-hydroxyphenyl)-3,3,5-trimethylcyclohexane.

The heat-resistant layer of a dye-donor element according to the present invention may advantageously comprise a lubricant such as a surface-active agent, a liquid lubricant, a solid lubricant, or mixtures thereof. Surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons, and glycols. Examples of solid lubricants include various higher alcohols such as stearyl alcohol, fatty acids, fatty acid esters, talc, teflon beads, and silica particles.

Preferred lubricants are polysiloxane-polyether copolymers and glycerol monostearate used alone or in combination with one another. Other lubricants have been described in e.g. U.S. Pat. Nos. 4,753,921, 4,916,112, 4,717,711, 4,717,712, 4,866,026, and 4,829,050. The amount of lubricant used in the heat-resistant layer largely depends on the type of lubricant, but generally is within the range of from about 0.1 to 50 weight percent (wt %), preferably 0.5 to 40 wt %. in respect of the binder or binder mixture employed.

As mentioned above the lubricants can be incorporated into the heat-resistant layer. Advantageously, however, a separate top layer comprising at least one lubricant is coated on top of the heat-resistant layer. Preferably, a top layer of a polyether-polysiloxane copolymer, optionally in combination with glycerol monostearate, is coated from a non-solvent for the heat-resistant layer on the latter layer. Another preferred separate top layer comprising lubricants has been described in the above-mentioned EP-A 92200229.0 and the corresponding U.S. Ser. No. 07/921,087 filed Jul. 29, 1992, now U.S. Pat. No. 5,234,888.

The heat-resistant layer of the dye-donor element of the present invention may contain other additives provided such additives do not impair the anti-sticking properties of the heat-resistant layer and provided that such materials do not scratch, erode, contaminate, or otherwise damage the thermal printing head or harm the image quality. Examples of suitable additives have been described in EP 389.153.

The heat-resistant layer of the dye-donor element of the present invention is formed preferably by adding the polymeric thermoplastic binder or binder mixture, the lubricant(s), and other optional components to a suitable solvent or solvent mixture, dissolving or dispersing the ingredients to form a coating composition, applying the coating composition to a support, which may first have been provided advantageously with an above-mentioned subbing layer, and dried.

The heat-resistant layer of the dye-donor element may be coated on the support or printed thereon by a printing technique such as a gravure process.

The heat-resistant layer thus formed has a thickness of about 0.1 to 3 μm, preferably 0.3 to 1.5 μm.

When the dye-donor-element of the present invention comprises a subbing layer between the support and the dye layer, a better adhesion between both is achieved. The dye layer comprises a dye or a dye mixture and a binder or a binder mixture.

Any dye can be used in the dye layer of the dye-donor element of the present invention provided it is transferable to the dye-image-receiving layer by the action of heat. Examples of suitable dyes have been described in e.g. EP 432,829, EP 400,706, EP-A 90203014.7 and the corresponding U.S. Ser. No. 07/789,674, EP-A 91200218.5 and the corresponding U.S. Ser. No. 07/821,564. EP-A 91200791.1 and the corresponding U.S. Ser. No. 07/682,389, and in the references cited in the above documents.

The ratio of dye or dye mixture to the binder ranges from 9:1 to 1:3 by weight, preferably from 3:1 to 1:2 by weight.

At least one of the following polymers can be chosen for use as a binder for the dye layer: cellulose derivatives e.g. as ethyl cellulose, hydroxyethyl cellulose, ethylhydroxyethyl cellulose, hydroxypropyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, and cellulose triacetate: vinyl-type resins and derivates e.g. polyvinyl alcohol, polyvinyl acetate, polyvinyl butyral, poly(vinylbutyral-co-vinylacetalco-vinylalcohol), polyvinyl pyrrolidone, polyvinyl acetoacetal, and polyacrylamide: polymers and copolymers derived from acrylates and acrylate derivatives e.g. polyacrylic acid, polymethyl methacrylate, and styrene-acrylate copolymers: polyester resins: polycarbonates: poly(styrene-co-acrylonitrile): polysulfones: polyphenylene oxide: organosilicones e.g. polysiloxanes: epoxy resins: natural resins e.g. gum arabic: and alkyd resins e.g. Neolyn 35 (Hercules, Netherlands). Preferably, the dye layer of the present invention comprises a poly(styrene-co-acrylonitrile).

The dye layer may also contain other additives such as e.g. thermal solvents, stabilizers, curing agents, preservatives, organic or inorganic fine particles, dispersing agents, antistatic agents, defoaming agents, and viscosity-controlling agents, these and other ingredients being described more fully in EP 133,012, EP 111,004 and EP 279,467.

Especially preferred organic fine particles for use in the dye layer are polyethylene, polypropylene, or amide wax particles.

A dye-barrier layer comprising a hydrophilic polymer may also be provided in the dye-donor element between the support and the dye layer to prevent wrong way transfer of dye towards the support and thus enhance the dye transfer density values. The dye barrier layer may contain any hydrophilic material that is useful for the intended purpose. In general, good results have been obtained with e.g. gelatin, polyacrylamide, polyisopropyl acrylamide, butyl methacrylate-grafted gelatin, ethyl methacrylate-grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid, and a mixture of cellulose monoacetate and polyacrylic acid. Suitable dye barrier layers have been described in e.g. EP 227,091 and EP 228,065.

When a dye barrier layer is used, the subbing layer of the present invention can be applied between the support and the dye-barrier layer or between the dye-barrier layer and the dye layer.

A dye-barrier layer that also functions as a subbing layer can be prepared by mixing the copolyesters for use according to the present invention with polymers exhibiting dye barrier properties such as e.g. gelatin and polyvinyl alcohol.

Any material can be used as the support for the dye-donor element provided it is dimensionally stable and capable of withstanding the temperatures involved, up to about 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper, and condenser paper. Preference is given to a support comprising polyethylene terephthalate. In general, the support has a thickness of 2 to 30 μm.

The support for the receiver sheet used in combination with the dye-donor element may be a transparent film of e.g. polyethylene terephthalate, a polyether sulfone, a polyimide, a cellulose ester, or a polyvinyl alcohol-co-acetal. The support may also be a reflective one such as baryta-coated paper, polyethylene-coated paper, or white polyester i.e. white-pigmented polyester. Blue-coloured polyethylene terephthalate film can also be used as a support.

To avoid poor adsorption of the transferred dye to the support of the receiver sheet this support should be coated with a special stratum, called dye-image-receiving layer, into which the dye can diffuse more readily. The dye-image-receiving layer may comprise e.g. a polycarbonate, a polyurethan, a polyester, a polyamide, polyvinyl chloride, poly(styrene-co-acrylonitrile), and polycaprolacton or mixtures thereof. Suitable dye-image-receiving layers have been described in e.g. EP 133,011, EP 133,012, EP 144,247, EP 227,094, EP 228,066. The dye-image-receiving layer may also comprise a cured binder such as the heat-cured product of poly(vinyl chloride-co-vinyl acetate-co-vinyl alcohol) and polyisocyanate.

In order to improve the light resistance and other stabilities of recorded images, UV absorbers, singlet oxygen quenchers such as HALS-compounds (Hindered Amine Light Stabilizers) and/or antioxidants can be incorporated into the dye-image receiving layer.

The dye layer of the dye-donor element and/or the dye-image-receiving layer of the receiver sheet may also contain a releasing agent that aids in separating the dye-donor element from the receiver sheet after transfer. The releasing agents can also be provided in a separate layer on at least part of the dye layer or of the dye-image-receiving layer. Solid waxes, fluorine, or phosphate-containing surfactants and silicone oils can be used as releasing agent. Suitable releasing agents have been described in e.g. EP 133,012, JP 85/19138, and EP 227,092.

The thermal dye sublimation transfer printing process comprises placing the dye layer of the donor element in face-to-face relation with the dye-image-receiving layer of the receiver sheet and image-wise heating from the back of the dye-donor element. The transfer of the dye is accomplished by heating for several milliseconds at about 400° C.

When the process is performed for but one single colour, a monochrome dye transfer image is obtained. A multicolour image can be obtained by using a dye-donor element containing three or more primary colour dyes and sequentially performing the process steps described above for each colour. The above sandwich of dye-donor element and receiver sheet is formed on three occasions during the time when heat is applied by the thermal printing head. After the first dye has been transferred, the elements are peeled apart. A second dye donor element (or another area of the dye-donor element with a different dye area) is then brought in register with the receiving sheet and the process is repeated.

The third colour and optionally further colours are obtained in the same manner.

In addition to thermal printing heads, laser light, infrared flash, or heated pens can be used as the heat source for supplying heat energy. Thermal printing heads that can be used to transfer dye from the dye-donor elements of the present invention to a receiver sheet are commercially available. In case laser light is used, the dye layer or another layer of the dye donor-element should contain a compound e.g. carbon black that absorbs the light emitted by the laser and converts it into heat.

Alternatively, the support of the dye-donor element may be an electrically resistive ribbon consisting of e.g. a multilayer structure of a carbon-loaded polycarbonate coated with a thin aluminium film. Current is injected into the resistive ribbon by electrically addressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology as compared to the thermal head technology, in which latter case the various elements of the thermal printing head get hot and must cool down before the head can move to the next printing position.

The following examples illustrate the invention in more detail without, however, limiting the scope thereof.

EXAMPLE 1

Preparation of the copolyesters for use according to the present invention.

The comonomers listed in Table 1 are introduced in a polymerization reactor together with 0.2 mmol of manganese acetate tetrahydrate, 0.1 mmol of $Sb_2O_3$, and 0.2 mmol of tetraisopropyl titanate (relative to 1 mol of copolyester). This mixture is heated under nitrogen up to 200° C. Methanol is removed from the reactor during a heating period of 90 min.

After esterification, the reactor is heated to 255° C. 0.2 mmol of triphenyl phosphate is introduced in the heated reactor and vacuum is applied. The melt viscosity increases slightly during stage I of the polycondensation (see FIG. I). After some 52 min of polycondensation, the viscosity increases dramatically, thus indicating that crosslinking takes place (see stage II in FIG. I). After a given time of crosslinking, vacuum is released and the copolyester obtained is removed from the reactor. The copolyester obtained is soluble in organic solvents such as methyl ethyl ketone.

Other copolyesters for use according to the present invention are prepared according to the same polymerization technique. The concentration of the different comonomers used for preparing the copolyesters (CP) is indicated in Table 1 in mol % (excess ethylene glycol is removed during the polycondensation reaction).

TABLE 1

| | TERE | ISO | EG | NPG | AA | GLY | TMA | PETR |
|---|---|---|---|---|---|---|---|---|
| Copolyester | | | | | | | | |
| CP1 | 44 | 44 | 33 | 66.5 | 12 | 0.5 | — | — |
| CP2 | 44 | 44 | 33 | 67 | 11.5 | — | 0.5 | — |
| CP3 | 44 | 44 | 33 | 66.8 | 12 | — | — | 0.2 |
| CP4 | 44 | 44 | 66.5 | 33 | 12 | 0.5 | — | — |
| CP5 | 50 | 50 | 33 | 66.5 | — | 0.5 | — | — |
| Comparative copolyesters | | | | | | | | |
| CP6 | 44 | 44 | 33 | 67 | 12 | — | — | — |
| CP7 | Vitel PE 222 (GOODYEAR): Linear aromatic polyester | | | | | | | |

The acronyms used in Table 1 have the following significances:
TERE: Terephthalic acid
EG: Ethylene glycol
AA: Adipic acid
ISO: Isophthalic acid
NPG: Neopentyl glycol
GLY: Glycerol
TMA: Trimellitic acid
PETR: Pentaerithrytol

EXAMPLE 2

A dye-donor element for use according to thermal dye sublimation transfer was prepared as follows.

A solution comprising 8 wt % of dye A. 2.4 wt % of dye B. 6.4 wt % of dye C, and 8 wt % of poly(styrene-co-acrylonitrile) as binder in methyl ethyl ketone as solvent was prepared.

From this solution a dye layer having a wet thickness of 10 μm was coated on a 6 μm thick polyethylene terephthalate film support provided with a conventional subbing layer. The resulting dye layer was dried by evaporation of the solvent.

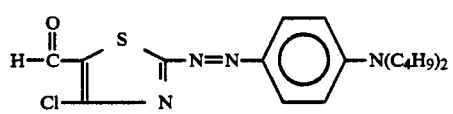

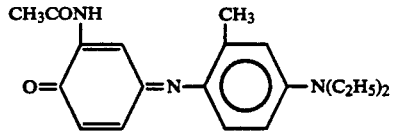

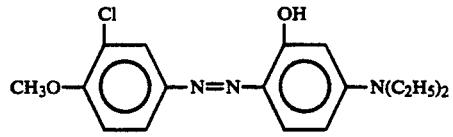

The opposite side of the film support was coated with a subbing layer and a heat-resistant layer as indicated in Table 2. The concentrations given in Table 2 are weight percentages in methyl ethyl ketone.

The heat-resistant layer was coated with a top coat of 50 mg/m2 of a polysiloxane polyether copolymer sold under the trade mark TEGOGLIDE 410 by TH. GOLDSCHMIDT AG, the top coat serving as a slipping layer. All coating liquids were applied at a wet thickness of 10 μm.

A receiving sheet was prepared by coating a dye-image-receiving layer containing 7.2 g/m² of poly(vinyl chloride-co-vinyl acetate-co-vinyl alcohol) (VINYLITE VAGD sold by UNION CARBIDE). 0.72 g/m² of diisocyanate (DESMODUR VL sold by BAYER AG), and 0.2 g/m² of hydroxy-modified polymethyl siloxane (TEGOMER H SI 2111 sold by TH. GOLDSCHMIDT AG) on a 175 μm thick polyethylene terephthalate film support.

The dye-donor element was printed in combination with the receiving sheet in a Mitsubishi colour video printer CP100E.

The rear side of the non-printed dye-donor element (i.e. the side carrying the slipping layer) was subjected to a tape adhesion test. A small piece of transparent tape was firmly pressed by hand on part of the dye-donor element. The tape was torn off manually. It was then evaluated visually whether the heat-resistant layer was removed together with the tape. Ideally nothing of this heat-resistant layer was to be removed.

For all the above visual evaluations the following categories were established: poor adhesion (P), moderate (M), good (G), and excellent (E).

This tape test experiment was repeated for each of the dye-donor elements identified in Table 2.

TABLE 2

| | Subbing layer ingredients | | Heat-resistant layer | Tape |
|---|---|---|---|---|
| Nr. | Copolyester | Additive | ingredients | test |
| 1 | 0.25% CP6 (COMP) | — | 13% C2 | P |
| 2 | 0.5% CP6 (COMP) | — | 13% C2 | M |
| 3 | 0.25% CP7 (COMP) | — | 13% C2 | P |
| 4 | 0.5% CP7 (COMP) | — | 13% C2 | M |
| 5 | 0.25% CP1 | — | 13% C2 | G |
| 6 | 0.5% CP1 | — | 13% C2 | E |
| 7 | 0.5% CP2 | — | 13% C2 | E |
| 8 | 0.5% CP3 | — | 13% C2 | E |
| 9 | 0.5% CP4 | — | 13% C2 | E |
| 10 | 0.5% CP5 | — | 13% C2 | E |
| 11 | 0.5% CP4 | — | 13% C1 | G |
| 12 | 0.5% CP4 | 0.5% C3 | 13% C1 | G |
| 13 | 1% CP1 | — | 13% C4, 1% C5(*) | E |
| 14 | 1% CP1 | — | 5% C6, 1% C5(*) | E |
| 15 | 1% CP1 | — | 5% C7, 1% C5(*) | E |

(*)without a top coat slipping layer.

The acronyms used in Table 2 have the following significances:

COMP stands for comparison (comparison test)

C1 Polycarbonate containing 45 mol % of Bisphenol A and 55 mol % of monomer A corresponding to the following structural formula:

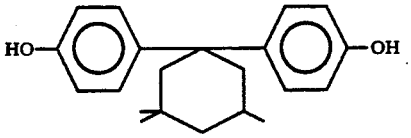

C2 Polycarbonate containing 100 mol % of monomer A.

C3 1,2-dihydroxybenzene

C4 Poly(styrene-co-acrylonitrile) - LURAN 388S (BASF. Germany)

C5 TEGOGLIDE 410 - (TH. GOLDSCHMIDT AG, Germany)

C6 Cellulose nitrate - (WOLFF WALSROD, Germany)

C7 Cellulose acetate propionate - PLFS 130 (CELANESE. USA).

As can be derived from Table 2, the copolyesters for use according to the present invention can be employed in very low thickness values (see tape test experiments 5–12). The use of linear polyesters, however, results in a poor or moderate adhesion between the heat-resistant layer and the support when used at such low thickness values (see tape test experiments 1–4 carried out with the comparison copolyesters). It is believed that linear copolyesters are easily dissolved when they are overcoated with the heat-resistant layer. This results in a poor adhesion and in a reduced heat-stability of the heat-resistant layer, since the copolyesters used as adhesives have a lower glass transition temperature than the polymers used for the heat-resistant layer.

The tape test experiments 13 to 15 illustrate the use of the copolyesters of the present invention for other heat-resistant layers known in the art of thermal dye sublimation transfer.

EXAMPLE 3

A dye-donor element for use according to thermal dye sublimation transfer was prepared as follows:

One side of a 6 μm thick polyethylene terephthalate film support was provided in the given sequence with a subbing layer of the copolyester CP4, a heat-resistant layer of compound C1, and a slipping layer of TEGOGLIDE 410 - ( TH. GOLDSCHMIDT AG. Germany).

The opposite side of the film support was coated with a subbing layer having a wet thickness of 10 μm. the subbing layer having the composition given in Table 3. The percentage values are weight percentages in the coating solution. A dye layer having the same composition as that described in Example 2 was coated on top of the subbing layer.

The adhesion between the support and the dye layer was evaluated by the above described tape test. The results of the test are listed in Table 3 hereinafter.

TABLE 3

| Nr. | Subbing layer ingredients | | Tape-test |
|---|---|---|---|
| 1 | 1.5% CP4 | — | G |
| 2 | 1.0% CP4 | 1.5% C3 | G |

The examples listed above illustrate that the copolyesters can also be used advantageously in a subbing layer for the dye layer.

We claim:

1. Dye-donor element for use according to thermal dye sublimation transfer comprising a support having on one side a dye layer and on the other side a heat-resistant layer, said support carrying on at least one side a subbing layer comprising a polyester formed by polycondensation of at least one aromatic dicarboxylic acid and at least one aliphatic diol, wherein said polyester is a copolyester further comprising units derived from at least one multifunctional comonomer carrying at least 3 functional groups, which may be same or different and are chosen from hydroxy, carboxy groups and latent carboxy groups.

2. Dye-donor element according to claim 1, wherein said multifunctional comonomer is glycerol trimethylolpropane, pentaerithrytol, trimellitic acid, trimellitic anhydride, or pyromellitic acid.

3. A dye-donor element according to claim 1, wherein said copolyester further contains units derived from aliphatic difunctional comonomers having both hydroxy and carboxy groups and/or units derived from aliphatic dicarboxylic acids.

4. A dye-donor element according to claim 1, wherein said copolyester comprises 0.1 to 10 mol % of units derived from said at least one multifunctional comonomer.

5. A dye-donor element according to claim 1, wherein said copolyester comprises 0.25 to 5 mol % of units derived from said at least one multifunctional comonomer.

6. A dye-donor element according to claim 1 wherein said heat-resistant layer comprises at least one polycarbonate derived from a bis-hydroxyphenyl)-cycloalkane corresponding to the following general formula:

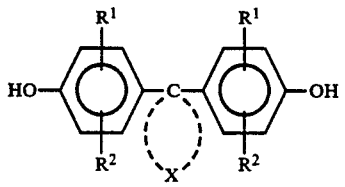

wherein:

each of $R^1$ and $R^2$ represents hydrogen, a halogen atom, a $C_1$–$C_8$ alkyl group, a $C_5$–$C_6$ cycloalkyl group, a $C_6$–$C_{10}$ aryl group, or a $C_7$–$C_{12}$ aralkyl group, X represents the atoms needed to close a 5- to 8-membered cycloaliphatic ring, which may be substituted with one or more $C_1$–$C_6$ alkyl groups or 5- or 6-membered cycloalkyl groups and which may carry fused-on 5- or 6-membered cycloalkyl groups.

7. A dye-donor element according to claim 6, wherein said bis-hydroxyphenyl)-cycloalkane is 1,1-bis-(4-hydroxyphenyl)-3,3,5-trimethylcyclohexane.

8. A dye-donor element according to claim 1, wherein said heat-resistant layer comprises a lubricant.

9. A dye-donor element according to claim 1, wherein a separate top layer comprising at least one lubricant has been coated on top of said heat-resistant layer.

10. A dye-donor element according to claim 1, wherein said subbing layer has been applied between said support and said dye layer.

11. A dye-donor element according to claim 1, wherein said dye layer further comprises a poly(styrene-co-acrylonitrile).

12. A dye-donor element according to claim 11, wherein said dye layer further comprises polyethylene, polypropylene, or amide wax particles.

13. A dye-donor element according to claim 1, wherein a said subbing layer has been applied on both sides of said support.

* * * * *